United States Patent [19]

Henschen et al.

[11] Patent Number: 4,990,736

[45] Date of Patent: Feb. 5, 1991

[54] GENERATING ELECTROMAGNETIC FIELDS IN A SELF REGULATING TEMPERATURE HEATER BY POSITIONING OF A CURRENT RETURN BUS

[75] Inventors: Homer E. Henschen, Carlisle; Michael J. McKee, New Cumberland; Joseph M. Pawlikowski, Lancaster, all of Pa.

[73] Assignee: AMP, Incorporated, Harrisburg, Pa.

[21] Appl. No.: 277,170

[22] Filed: Nov. 29, 1988

[51] Int. Cl.[5] ..... H05B 6/00

[52] U.S. Cl. ..... 219/10.75; 219/85.1; 219/209; 219/542

[58] Field of Search ..... 219/10.75, 553, 542, 219/85.1, 209

[56] References Cited

U.S. PATENT DOCUMENTS

| | | | |
|---|---|---|---|
| 4,256,945 | 3/1981 | Carter | 219/10.75 |
| 4,623,401 | 11/1986 | Derbyshire | 148/13 |
| 4,626,767 | 12/1986 | Clappier | 323/280 |
| 4,659,912 | 4/1987 | Derbyshire | 219/535 |
| 4,695,712 | 9/1987 | Busch | 219/553 X |
| 4,695,713 | 9/1987 | Krumme | 219/553 |
| 4,701,587 | 10/1987 | Carter | 219/10.75 |
| 4,717,814 | 1/1988 | Krumme | 219/553 |
| 4,745,264 | 5/1988 | Carter | 219/553 |
| 4,788,404 | 11/1988 | Kent | 219/542 X |
| 4,814,587 | 3/1989 | Carter | 219/553 X |
| 4,849,611 | 7/1989 | Whitney et al. | 219/553 X |

FOREIGN PATENT DOCUMENTS 0241597 10/1987 European Pat. Off. .

*Primary Examiner*—Philip H. Leung
*Attorney, Agent, or Firm*—David L. Smith

[57] ABSTRACT

A self-redulanting heater includes an electrically-conductive substrate (11), having a magnetic surface layer (13) of one skin depth, folded 180 degrees to define two heater sections joined by a fold section. The magnetic material has a considerably higher resistance than the substrate material. The surfaces of the two sections clad with the surface layer are in closely spaced parallel relation and connected in series by the fold section (23) such that a constant amplitude alternating energizing current flows in opposite directions through the two sections at any instant of time to thereby establish an electric field between the two heaters. The field concentrates current flow at the two facing surfaces. Depth of the current is determined by the skin effect phenomenon and increases significantly at temperatures above the Curie temperature of the magnetic material.

13 Claims, 2 Drawing Sheets

GENERATING ELECTROMAGNETIC FIELDS IN A SELF REGULATING TEMPERATURE HEATER BY POSITIONING OF A CURRENT RETURN BUS

BACKGROUND OF THE INVENTION

The present invention relates to self-regulating heaters and methods for manufacturing such heaters. The self-regulating heaters of the present invention have particular utility for soldering applications but are suitable for a variety of other applications in which regulated localized heating is desirable.

Specific soldering applications in which the heater of the present invention is useful are disclosed in the following co-pending U.S. Pat. App.Ser. No. 07/277,116 filed Nov. 29, 1988 filed by McKee et al and entitled "Self Regulating Temperature Heater With Thermally Conductive Extensions"; Ser. No. 07/277,361 filed Nov. 29, 1988 filed by McKee et al and entitled "Self Regulating Temperature Heater Carrier Strip"; and Ser. No. 07/277,362 filed by McKee et al and entitled "Surface Mount Technology Breakaway Self Regulating Temperature Heater"; all filed concurrently herewith and owned by the same assignee as the present application. The disclosures in all of the above patent applications are expressly incorporated herein in their entireties.

The present invention makes use of a relatively new automatic self-regulating heater technology disclosed in U.S. Pat. Nos. 4,256,945 (Carter et al), 4,623,401 (Derbyshire et al), 4,659,912 (Derbyshire), 4,695,713 (Krumme), 4,701,587 (Carter et al), 4,714,814 (Krumme) and 4,745,264 (Carter). The disclosures in these patents are expressly incorporated herein by reference. A heater constructed in accordance with this technology, hereinafter referred to as a self-regulating heater, employs an electrical conductor of copper, copper alloy or other material of low electrical resistivity, negligible magnetic permeability and high thermal conductivity. A surface layer of thermally-conductive magnetic material is disposed on all or part of the surface of the conductor, the surface layer material typically being iron, nickel or nickel-iron alloy, or the like, having a much higher electrical resistance and magnetic permeability than the conductor material. The thickness of the surface layer is approximately one skin depth, based on the frequency of the energizing current and the permeability and resistance of the surface layer. A constant amplitude high frequency alternating energizing current is passed through the heater and, as a result of the skin effect phenomenon, is initially concentrated in one skin depth corresponding to the thickness of the magnetic surface layer. When the temperature at any point along the heater reaches the Curie temperature of the magnetic material, the magnetic permeability of the material at that point decreases dramatically, thereby significantly increasing the skin depth so that the current density profile expands into the non-magnetic conductor of low resistivity. The overall result is a lower resistance and lesser heat dissipation. If thermal sinks or loads are placed in contact with the heater at different locations along the heater length, thermal energy is transferred to the loads at those locations with the result that the temperature does not rise to the Curie temperature as quickly at those locations as it does in the non-loaded locations. The constant amplitude current remains concentrated in the higher resistance surface layer at the loaded locations which dissipate considerably more resistive heating energy than is dissipated in the non-load locations where the current is distributed in the low resistance conductor.

In order to effect multiple soldering operations simultaneously it is convenient to configure the self-regulating heater as a substrate of electrically conductive material on which the magnetic surface layer is deposited or otherwise disposed. Unless otherwise constrained, the energizing current passing through the heater is distributed according to the skin effect phenomenon at all of the heater surface portions, not merely the surface portions clad with the magnetic surface layer. Thus, unless all of the surface portions of the substrate conductor are clad with the magnetic surface layer, the effectiveness and efficiency of the self-regulating feature of the heater are significantly diminished. In the aforementioned U.S. Patent Application Ser. No. 07/277,116, for example, there is described a heater embodiment in which both the top and bottom surfaces of the substrate conductor are clad with the magnetic surface material, it being recognized that the surface area corresponding to the thickness dimension of the substrate is so small as to have negligible effect on the overall current distribution in the substrate if permitted to remain unclad with the magnetic material. This configuration, also useful for some soldering applications, has the disadvantage of a relatively low impedance. More particularly, since the two surface layers are effectively connected in parallel, the overall impedance of the heater is lower than would be the case if the current were some how constrained to flow along only one surface. The importance of the low impedance relates to the necessity for matching the impedance of the load (i.e., the heater) to the impedance of the energizing current source in order to maximize power transfer to the load. Since the impedance of the source is typically on the order of fifty ohms, and the impedance of the heater is typically on the order of one ohm, an impedance matching circuit capable of a fifty-to-one matching ratio is required. This ratio is difficult enough to attain without further exacerbation brought about by a reduced heater impedance. Moreover, if the load impedance is lowered, the required constant amplitude for the energizing current must be significantly increased to achieve the desired heating level.

Current can be constrained to flow primarily in the magnetic surface layer on a single surface of the heater by establishing an electric field oriented perpendicular to that surface. This can be achieved by providing a return bus for the energizing current, the bus being positioned such that one surface of the bus is spaced from the magnetic surface layer by a thin layer of insulation; the heater is then connected in series with the return bus across the energizing source. The direction of current flow through the heater at any instant of time is longitudinally opposite the direction of current flow through the return bus. A resulting electric field is developed across the insulation layer and acts to constrain the current through the heater to flow primarily in the magnetic surface layer. The return bus and insulation may be part of the tooling assembly employed during a soldering operation and must be both physically and electrically connected to the heater each time a soldering operation is performed.

It is desirable to provide a self-regulating heater which can be clad on only one surface without sacrificing its effectiveness as a self-regulating heater, yet which is simple to employ in a soldering operation. It is also desirable for the heater to be simple and inexpensive to fabricate. Further, the heater impedance that is useful in generating thermal energy should be maximized in order to: maximize thermal energy generated by the heater; minimize the amplitude of the energizing current; and reduce the impedance matching ratio between the energizing source and the heater.

SUMMARY OF THE INVENTION

In accordance with the present invention a self-regulating heater is formed by disposing a magnetic surface layer over one surface of a substrate conductor and then folding the substrate over on itself such that two portions of the surface layer are closely spaced by an inserted layer of insulation material. In one embodiment the fold line is oriented transversely of the length of the substrate, thereby dividing the heater into two longitudinal sections. The energizing current source is connected across the two ends of the unit so that current must flow through one section and then the other, whereupon each section serves as a return bus for the other. The high resistance magnetic surface layer extends along both sections to effectively double the length, and hence the resistance, of the heat dissipating portion of the heater.

In a second embodiment the substrate is folded over on itself about a longitudinally-extending fold line with the magnetic surface layer likewise being disposed in two sections spaced by an insulation layer. A cut-away slot portion extends from the proximal end of the substrate lengthwise along the fold line for the major part of the length of the substrate such that an electrically-conductive path exists between the two heater sections only at the distal end of the substrate. The energizing source is connected across the two heater sections at the proximal end of the substrate, whereby current flows lengthwise in opposite directions through the two sections at any instant of time.

BRIEF DESCRIPTION OF THE DRAWINGS

Specific embodiments of the present invention are illustrated in the accompanying drawings wherein like reference numerals of the various figures are utilized to designate like components, and wherein.

DESCRIPTION OF THE PREFERRED EMBODIMENTS

Figure 1:
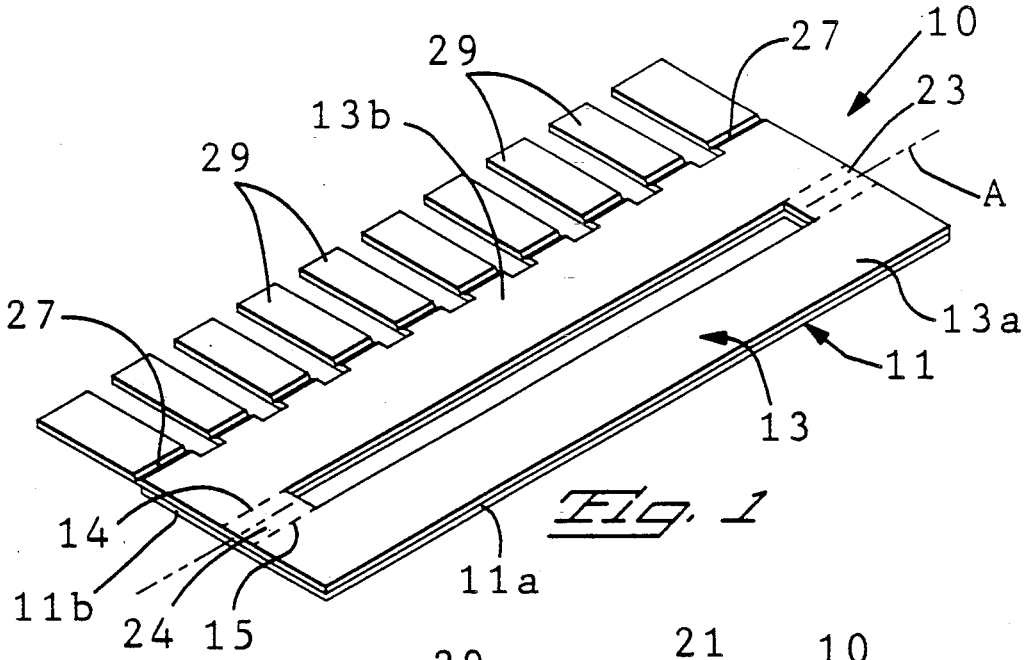
FIG. 1, is a view in perspective of a first embodiment of the present invention during an intermediate stage of manufacture.

Referring specifically to FIG. 1 of the accompanying drawings, there is illustrated a heater apparatus 10 of the present invention in an intermediate stage of manufacture. The apparatus includes an elongated rectangular substrate 11 of copper, copper alloy, phosphor bronze, beryllium copper, brass or other material having a high electrical conductivity (i.e., low resistivity) and negligible magnetic permeability (i.e., a permeability of, or close to, one). The substrate material must also be a good thermal conductor. Substrate 11 typically, although not necessarily, has a length greater than its width which, in turn, is much greater than its thickness. As an example of these relative dimensions, the substrate length may be three inches, its width may range from two-tenths of an inch to one inch, and its thickness may be on the order of 0.002 inch. It should be noted that the rectangular substrate configuration illustrated in FIG. 1 is merely an exemplary configuration and that substantially any configuration, consistent with the principles described herein, may be employed.

Substrate 11 has a longitudinally-extending slot 12 defined entirely through its thickness dimension. Slot 12 terminates at locations spaced inwardly from the opposite ends of substrate 11 and has a length that is typically in the ranqe of seventy to ninety percent of the substrate length. Thus, for a substrate length of three inches, slot 12 would typically be on the order of 2.4 inches with its ends equally spaced from the respective ends of the substrate. In the preferred embodiment of the present invention, slot 12 is centered widthwise in substrate 11 and typically has a width in the range of ten to thirty percent of the substrate width. Thus, if substrate 11 has a width of one inch, slot 12 would typically be two-tenths of an inch wide. Slot 12 is also centered widthwise about an imaginary fold line A extending longitudinally of the substrate for purposes to be described subsequently. A pair of score or perforation lines 14, 15 are defined in substrate 11 as longitudinal extensions of respective longitudinal sides of slot 12 and extend from one end of the slot to the nearby end of the substrate. Score lines 14, 15 facilitate removal of the portion of the substrate located therebetween.

A thermally-conductive surface layer 13 of magnetic material is deposited on or otherwise affixed to one surface of substrate Typically a roll cladding process is used where the magnetic material layer is laid over the substrate then subjected to high pressure and temperature which diffuses the two materials together at the boundary layer, but other processes such as plating or sputter depositing could be used. In the illustrated embodiment surface layer 13 having a typical thickness of 0.002 inch is disposed over the entirety of that surface but may be disposed only on selected surface portions. A typical material for surface layer 13 is iron, nickel or a nickel-iron alloy, such as Alloy 42 (forty-two percent nickel, fifty-eight percent iron), or Alloy 42–6 (forty-two percent nickel, six percent chromium, fifty-two percent iron); however, surface layer 13 may be any metal or alloy having the characteristics described herein. Depending upon the particular material, magnetic permeabilities for surface layer 13 ranqe from fifty to more than one thousand, as compared to a permeability of one for copper; typical electrical resistivities for surface layer 13 range from twenty to ninety microohms per centimeter as compared to 1.72 for copper.

Figure 2:
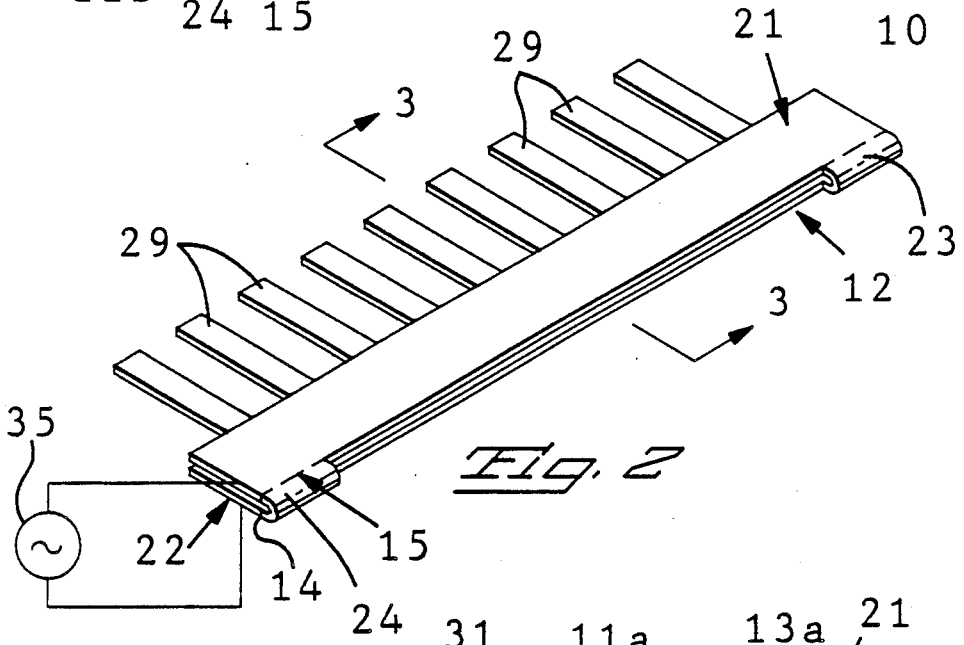
FIG. 2 is a view in perspective of the embodiment of FIG. 1 in its finished form with an energizing source illustrated schematically as being connected to the heater.
Figure 3:
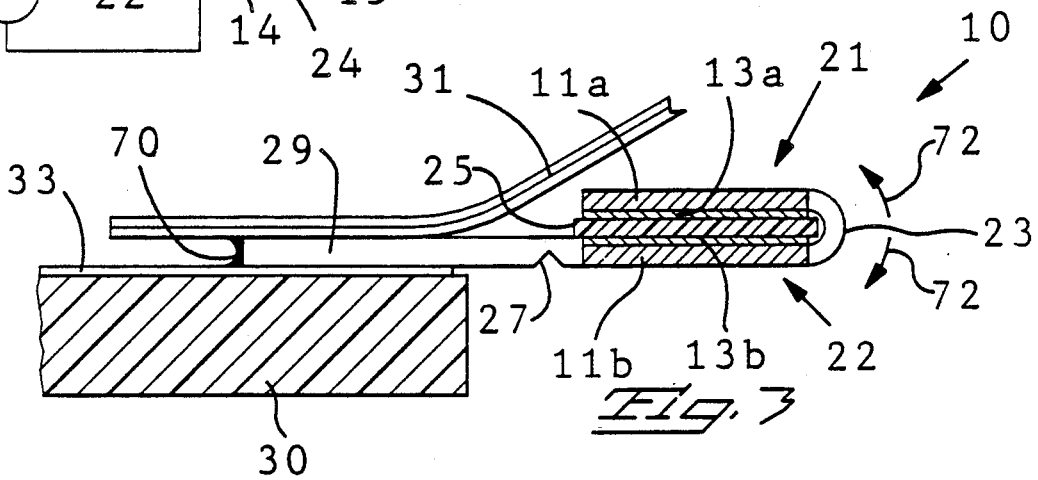
FIG. 3 is a view in section taken along lines 3—3 of FIG. 2 and showing the heater of FIGS. 1 and 2 positioned for use during a soldering operation.

Referring additionally to FIGS. 2 and 3, substrate 11, with its surface layer 13, is folded about fold line A in a substantially 180 degree bend to define two heater sections 21 and 22 joined by two fold sections 23 and 24 located at opposite ends of slot 12. Heater section 21 is comprised of substrate section 11*a* and substrate layer section 13*a*; heater section 22 is comprised of substrate section 11*b* and surface layer section 13*b*. Fold section 24 is defined between score lines 14, 15 and is removed after the folding operation, thereby leaving only fold section 23 to permanently join sections 21 and 22 at one end of the assembly. The bend is such that the surface of heater section 21 that is clad with surface layer section 13*a* faces the similarly clad surface layer section 13*b* of heater section 22 in closely spaced parallel relation. In the preferred embodiment, a layer 25 of electrically-insulative material is disposed between and in contact with both clad surfaces. Typically, insulation layer 25 is placed on the clad surface of one heater section prior to the folding operation so that the clad surface of the other heater section can be folded onto the insulation layer. If an insulation layer is employed (as opposed to merely leaving an air gap to provide insulation between the facing surfaces), an adhesive may be applied to both of the surfaces of the insulation layer to affix it to the two heater sections. In either case, heater sections 21 and 22 are connected in series circuit by fold section 23.

The thickness of surface layer 13 is typically one skin depth. In this regard the series-connected heater sections 21 and 22, when energized by passing a constant amplitude alternating current therethrough, function as self-regulating heaters. Specifically, for temperatures below the Curie temperature of the material of surface layer 13, slightly more than sixty-three percent of the constant amplitude current flowing through the heater is concentrated in one skin depth from the heater surface. The skin depth is proportional to the square root of the material resistivity, and is inversely proportional to the square root of the product of the magnetic permeability of the surface layer material and the frequency of the alternating current passing through the heater. At temperatures equal to or above the Curie temperature of the surface layer material, the magnetic permeability of that material drops to approximately the permeability of the substrate material (i.e., a permeability of one, for copper), thereby producing a dramatic increase in the skin depth. Consequently, much more of the constant amplitude current is distributed in the lower resistivity substrate 11 than in the higher resistivity surface layer 13, with the result that considerably less heat is dissipated in response to the energizing current. Importantly, if selected locations of the heater body are in contact with thermal energy absorptive loads (e.g., heat sinks), then the temperature at those locations of the heater body does not rise as readily as it does at the non-load locations. It is possible, therefore, for the constant amplitude current to be concentrated in surface layer 13 to a greater extent at the load locations (where the temperature is below the Curie temperature of surface layer 13) than at the non-load locations (where the temperature is equal to the Curie temperature of the surface layer material). Curie temperatures for materials can range from 50 degrees C. to 1,000 degrees C.; typical materials employed for surface layer 13 have Curie temperatures in the range of 200 degrees C to 500 degrees C., depending upon the particular application for the heater. A typical solder is 63 percent tin with the balance being lead, having a melting point of 183°C.

Although the fold-over heater of the present invention is useful as a self-regulating heater for a wide variety of applications, it has particular utility for soldering applications. The embodiment illustrated in FIGS. 1, 2 and 3 is intended for soddering applications in which conductors in a cable, for example, are to be soldered to respective contact pads on a circuit board. That application is more thoroughly illustrated and described in the above-mentioned patent application Ser. No. 07/277,116. With this function in mind, a plurality of thermally and electrically-conductive connecting members 29 project from the heater body. In the particular embodiment illustrated in FIGS. 1–3, there are ten connecting members 29 projecting from a common edge of the heater body in spaced parallel relation. The spacing between the connecting members 29 is determined by the spacing between contact pairs to be joined by soldering, as described below. Likewise, the configurations of the connecting members 29 are determined by the configurations of the contacts to be joined. In the illustrated embodiment the spacing is the same between each pair of adjacent connecting members, and the configurations of the connecting members are identical. Each connecting member 29 is in thermally-conductive relation with the heater body so that each member 29 may conduct thermal energy developed in the heater to a respective connection site where a soldering operation is to be performed. The connecting members may be formed by stamping, or the like, as integral parts of the substrate 11, in which case the thickness of each connecting member 29 may be on the same order of magnitude as the thickness of the substrate. Of course, the thickness of the connecting members may be greater or less than the thickness of the substrate. Each connecting member 29 is provided with a notch 27 extending transversely across the member and to a sufficient depth to permit the heater body to be broken away from the members 29 by bending, tearing, etc. Alternatively, the connecting members 29 may be scored, perforated or otherwise weakened in torsional strength to facilitate their separation from the heater body.

Referring specifically to FIGS. 2 and 3 of the accompanying drawings, heater assembly 10 is illustrated as being utilized to solder conductors 31 of a flexible etched cable to respective contact pads 33 on a printed circuit board 30. Although only a single cable conductor 31 and a single contact pad 33 are visible in FIG. 3, it is to be understood that plural spaced conductors 31 and plural spaced pads 33 are provided, and that all of the conductors 31 are to be soldered to respective contact pads 33 simultaneously. Conductor 31 is shown soldered to pad 33 via solder fillet 70 in FIG. 3, making mechanical and electrical contact through members 29. Initially, at each connection site, a finger-like connecting member 29 is placed on a respective contact pad 33. A predetermined amount of solder is provided on the pad, on member 29, or on conductor 31 to effect a proper mechanical and electrical solder joint without bridging to an adjacent pad. The spacing between connecting members 29 is manufactured to be the same as the spacing between contact pads 33, and the configuration of the connecting members is such that each member 29 contacts its respective contact pad 33 without contacting any other pad or circuit component on board 30. Each conductor 31 in the cable is then placed on a respective connecting member 29. Thus, at each connection site there is a flush physical contact between the three stacked electrically-conductive elements, namely, contact pad 33, connecting member 29 and cable conductor 31 and a predetermined amount of solder as described above.

As best illustrated in FIG. 2, a source 35 of constant amplitude alternating current is connected across the two heater sections 21 and 22 of the heater assembly 10 at one end of the heater assembly. Source 35 may be any suitable constant amplitude alternating current such as, for example, the source disclosed in U.S. Pat. No. 4,626,767 (Clappier et al) and provides a constant amplitude alternating signal, typically in the radio frequency range. Most commonly, the frequency of the energizing signal is 13.56 MHz. The constant amplitude of the signal is selected to provide the desired heating level. An impedance matching circuit is generally included in the power supply to match the impedance of the heater to the source impedance.

As described above, the two heater sections 21, 22 are connected in series by fold section 23. It will be appreciated, therefore, that current flow through the heater at any instant of time is in longitudinally opposite directions in the heater sections 21 and 22. A resulting electric field is established between the heater sections across insulation layer 25, thereby concentrating the current flowing through the heater assembly and the high resistance surface layer sections 13*a* and 13*b* rather than in low resistance substrate sections 11*a* and 11*b*. The reason for this may be explained as follows. Since the current amplitude is maintained constant at source 35, it is desirable, for optimal heating, to concentrate the current in the high resistance substrate layer sections 13*a* and 13*b*, rather than in low resistance substrate sections 11*a* and 11*b*. That is, the resistive heating, with the current maintained constant, is greater when the current path has greater resistance. The electric field developed by the oppositely-directed current flowing in heater sections 21 and 22 assures that the current in the heater assembly is concentrated in the high resistance surface layer sections. Details of a soldering operation using heater assembly 10 are set forth in the above-referenced U.S. Pat. App. Ser. No. 07/277,166.

The nature of heater assembly lo is such that the resistive heatinq is produced only where it is needed to effect soldering or other heating operations. More specifically, current through heater section 10 flows longitudinally and thereby alternately encounters regions from which connecting member 29 project and regions corresponding to spaces between the connecting members 29. In the particular embodiment being described there are no thermal loads, such as connecting members, extending directly from heater section 21. Thermal energy developed in regions proximate the connecting members in heater section 22 is conducted to respective solder connection sites by members 29, thereby preventing the temperature at those regions from building up quickly. On the other hand, in the regions corresponding to the spaces between connecting members 29 in heater section 22, and all along heater section 21, the temperature increases rapidly until it reaches the Curie temperature of the material of surface layer 13, whereupon the effective skin depth is increased dramatically in those regions. The causes more current to flow through the low resistance substrate material in these regions and, as a consequence, less thermal energy is produced therein. The regions proximate connecting members 29 in heater section 22 continue to develop high amounts of thermal energy that is connected to the respective connection sites. Overheating of the solder connection sites is prevented by the same mechanism; that is, once the temperature of the connection site reaches a stabilized level, thermal conduction from the heater to the site ceases, thereby removing the heat sink effect of the connection site. The thermal energy developed by the current flowing in the high resistance surface layer 13 then quickly increases the temperature proximate the connecting members 29 until the Curie temperature of the material is reached. At this point the effective skin depth along the entire length of both heater sections is increased so that more of the constant amplitude current flows through the low resistance substrate sections and significantly less thermal energy is produced by resistive heating. After current is removed from the heater assembly, the assembly begins to cool and the solder is permitted to harden. The cooling proceeds quickly because the relatively low mass of the heater does not retain its heat for long periods of time.

Heater assembly 10 is broken away from the severable connecting members 29 after the solder 70 hardens. This break away operation is effected by bending the heater relative to members 29 along the linearly-aligned notches or grooves 27 as indicated in FIG. 3 by arrows 72. The connecting members 29 remain a permanent part of the solder joint at each connection site and provide a low resistance current path between conductors 31 and contact pads 33.

Figure 4:
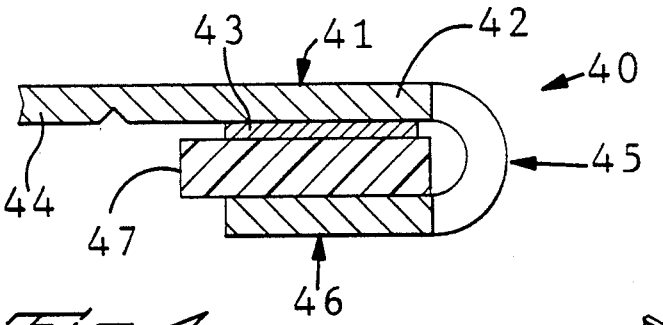
FIG. 4 is a view in transverse section of an alternative embodiment of the heater of the present invention.

Although the preferred embodiment of the present invention includes a magnetic surface layer on both of the folded heater sections, it is possible for certain applications to dispose the surface layer on only one of the folded sections. An exemplary embodiment employing only a single clad heater section is illustrated in FIG. 4. Specifically, a foldover heater assembly 40 is essentially similar to assembly 10 but includes only one heater section 41 comprising a substrate section 42 on which a magnetic surface layer 43 is disposed. Connecting members 44 extend from the longitudinal edge of heater section 41. Opposite section 46 of the assembly serves as a bus bar and is joined to the heater section 41 by fold section 45. Bus bar 46 is not a heater but functions with the heater section 41 to establish an electric field across insulation 47 to constrain heater section current flow at the surface of the heater section facing the bus bar.

Figure 5:
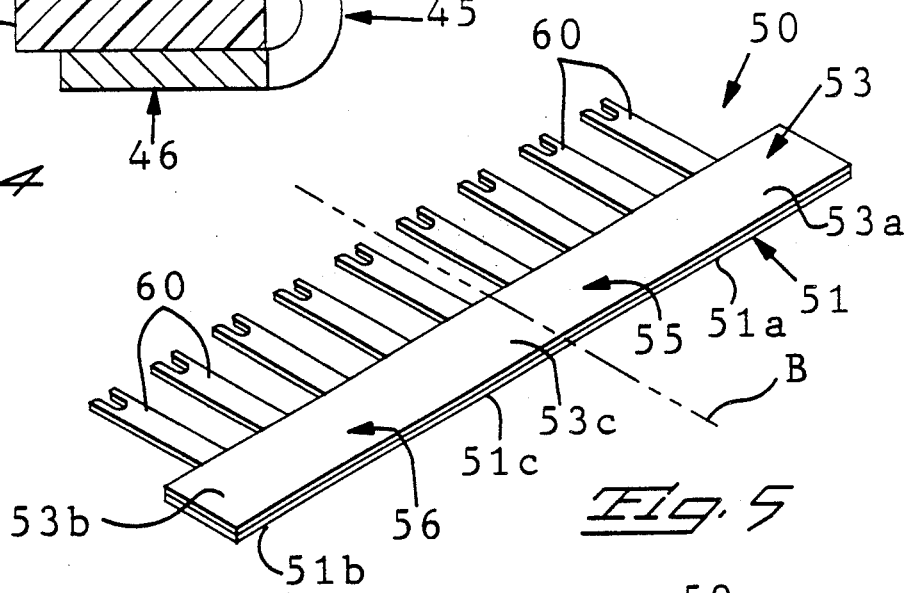
FIG. 5 is a view in perspective of still another embodiment of the heater of the present invention in an intermediate stage of manufacture.
Figure 6:
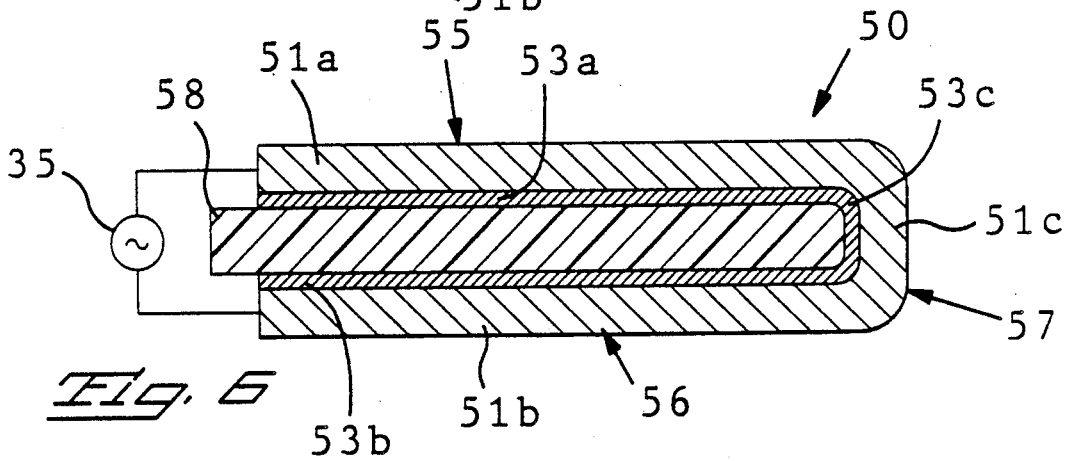
FIG. 6 is a view in transverse section of the heater embodiment of FIG. 5 fully assembled.

The foldover self-regulating heater of the present invention may also be fabricated by folding a substrate with its magnetic surface layer along a fold line extending transversely of its long dimension. An example of such an embodiment is illustrated in FIGS. 5 and 6. Heater assembly 50 includes a substrate 51 and surface layer 53 having the same electrical, magnetic and thermal characteristics as substrate 11 and surface layer 13, respectively. An imaginary fold line B extends transversely through the substrate, preferably, but not necessarily, at the substrate longitudinal center. After the surface layer 53 has been deposited or otherwise affixed to all or part of one substrate surface, the unit is folded through a bend of approximately 180 degrees to define first and second substantially parallel and spaced heater sections 55 and 56 joined in electrical series by a fold section 57. Substrate 51 includes three sections, namely sections 51*a*, 51*b* and 51*c* at the first heater section 55, second heater section 56 and fold section 57, respectively. Surface layer 53 includes three similar sections 53*a*, 53*b* and 53*c*. A layer of insulation 58 is preferably disposed between the two heater sections in contact with surface layer sections 53*a* and 53*b*. Insulation layer 58 is typically installed in the assembly prior to the folding step and is placed on one longitudinal half of the unfolded unit. Adhesive or the like may be used to secure the insulation layer to one or both surface layer sections 53*a*, 53*b*.

A plurality of longitudinally spaced electrical terminals 60 are preferably formed integrally with and project transversely from substrate 51 along one longitudinal edqe. As described in the aforementioned U.S. Pat. App. Ser. No. 07/277,361, the terminals 60 may be positioned, in the final folded heater assembly, such that terminals projecting from heater section 55 are interdigitated with terminals projecting from heater assembly 56. Alternatively, the terminals 60 may project from only one of the heater sections 55, 56. Score or perforation lines, or the like, are provided in the terminals 60 to facilitate their removal from the heater assembly after the terminals have been soldered to respective wires, or the like.

In operation, a source 35 of a constant amplitude alternating current is connected across the opposite longitudinal ends of the assembly, which ends are in closely spaced proximity after the unit has been folded. The current flows in opposite directions through the two heater sections at any instant of time to establish an electric field between the heater sections for constraining current flow toward the facing surfaces clad with the magnetic surface layer 53. Thermal energy is generated in the manner described above in relation to FIGS. 1, 2 and 3.

Figure 7:
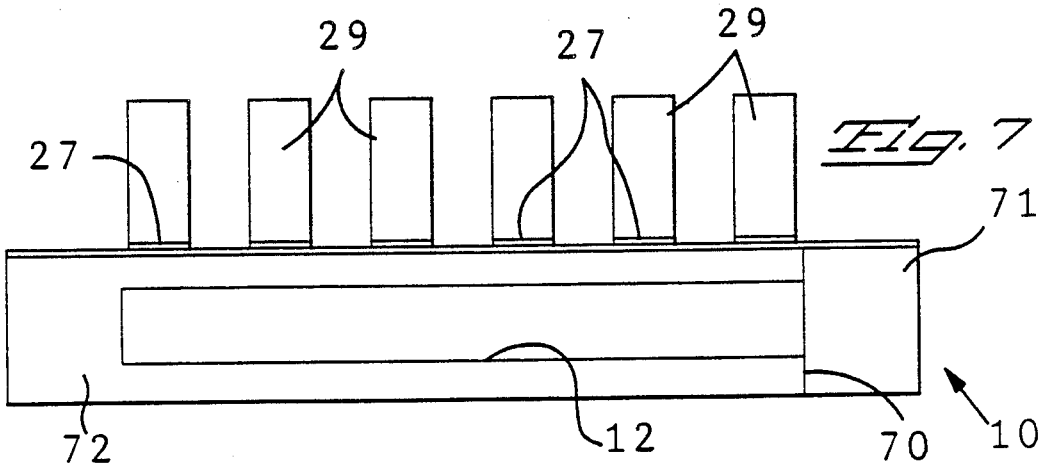
FIG. 7 is a top view in plan of still another heater embodiment of the present invention shown in an intermediate stage of manufacture.

The embodiment illustrated in FIG. 7 is identical to that of FIG. 1 except that a transverse single score line 70 replaces the two longitudinal score lines 14 and 15. Transverse score line 70 extends across the heater assembly co-linearly with one longitudinal end of slot 12. After the substrate has been folded, the entire segment 71 of the assembly, disposed between score lines 70 and the proximate end of the assembly, may be removed. The resulting structure includes two parallel and spaced heater sections joined by a fold section 72 at the opposite or distal end of the slot.

Although the various embodiments are disclosed with the folding step resulting in two identically sized halves of the original substrate, it should be appreciated that the fold can be about substantially any fold line. In addition, the rectangular configurations illustrated for both the unfolded substrate and final folded assembly should not be construed as limiting on the scope of the present invention; that is, the peripheral configuration of the original substrate and final folded assembly may be contoured as required for the particular heating application. Although the embodiments described herein are designed primarily for soldering applications, it is to be understood that the foldover self-regulating heater of the present invention may be utilized for a variety of other applications.

The foldover self-regulating heater of the present invention requires only one surface of a substrate to be clad with magnetic surface layer material and then simply configured into two series-connected heater sections. The two heater sections are positioned such that each serves as a current return path for the other and such that an electric field is developed between the two sections to constrain current flow through the mutually facing surfaces clad with the magnetic surface layer. Upon initial energization, the thermal energy developed by the two series-connected heater section is considerably greater than the thermal energy developed when a single heater section is used in conjunction with a separate bus bar. Moreover, it is not necessary to provide a separate bus bar that must be brought into and out of contact with the heater assembly to effect heater operation. Placing the two heater sections in series permits the overall heater assembly impedance to be increased as compared to a single heater section or a heater section having parallel current paths. This greatly facilitates impedance matching and minimizes the current amplitude required for the energizing current.

The insulation material employed in the embodiments disclosed herein may be Kapton, or the like. Other electrically-insulative paper or plastic layers may be employed.

From the foregoing it will be appreciated that the present invention makes available a novel self-regulating heater apparatus and method for fabricating that apparatus.

Having described preferred embodiments of a new and improved method and apparatus for generating thermal energy, or the like, it is believed that other modifications, variations and changes will be suggested to those skilled in the art in view of the teachings set forth herein. It is therefore to be understood that all such variations, modifications and changes are believed to fall within the scope of the present invention as defined by the appended claims.

We claim:

1. A self-regulating heater comprising:

a substrate of a first material, said substrate having length, width and thickness dimensions wherein said length and width dimensions are very much larger than said thickness dimension, said first material having a relatively low electrical resistance and a relatively low magnetic permeability, said substrate begin folded to define first and second spaced parallel sections joined by a fold section, said fold section being an approximately 180 ° bend about a fold line (A) extending generally parallel to said length dimension and transversely of said width dimension;

said first section including a first surface layer of a second material having a predetermined depth and fixedly disposed on an inwardly-facing surface of said first section, said second material having an electrical resistance substantially greater than said relatively low electrical resistance, and a magnetic permeability which is substantially higher than said relatively low magnetic permeability at temperatures below the Curie temperature of said second material but substantially the same as said relatively low magnetic permeability at temperatures above said Curie temperature, said heater being adapted to be actuated by passing a constant amplitude alternating current therethrough at a predetermined frequency, and wherein said predetermined depth corresponds to approximately one skin depth; and said second section also including a surface layer of said second material of said predetermined depth fixedly disposed on an inward-facing surface of said second surface.

2. The heater according to claim 1 wherein said substrate includes first and second opposite longitudinal ends and a slot defined entirely through said thickness dimension extending longitudinally along said fold line from said first end of said substrate to a predetermined location spaced from said second end of said substrate, and wherein said fold section extends between said predetermined location and said secured end.

3. The heater according to claim 1 wherein said substrate includes first and second opposite longitudinal ends and a slot defined entirely through said thickness dimension extending longitudinally along said fold line from said first end of said substrate to a predetermined location spaced from said second end of said substrate, and wherein said fold section extends between said predetermined location and said secured end.

4. The heater as recited in claim 1 wherein said first and second surface layers are comprised of a continuous layer of said second material extending along said first and second sections and said fold section.

5. A self-regulating heater comprising:

a substrate of a first material, said substrate having length, width and thickness dimensions wherein said length and width dimensions are very much larger than said thickness dimension, said first material having a relatively low electrical resistance and a relatively low magnetic permeability, said substrate being folded to define first and second spaced parallel sections joined by a fold section;

said first section including a first surface layer of a second material having a predetermined depth and fixedly disposed on an inwardly-facing surface of said first section, said second material having an electrical resistance substantially greater than said relatively low electrical resistance, and a magnetic permeability which is substantially higher than said relatively low magnetic permeability at temperatures below the Curie temperature of said second material but substantially the same as said relatively low magnetic permeability at temperatures above said Curie temperature, said heater being adapted to be actuated by passing a constant amplitude alternating current therethrough at a predetermined frequency, wherein said predetermined depth corresponds to approximately one skin depth; and said second section also including a surface layer of said second material of said predetermined depth fixedly disposed on an inward-facing surface; and a plurality of thermally-conductive members formed integrally with said substrate and extending from at least one edge of said substrate.

6. The heater according to claim 5 wherein said thermally-conductive members are electrically conductive and extend from a longitudinally-extending edge of said substrate, each of said members including a structurally weakened portion to facilitate severing of the member from said substrate.

7. The heater according to claim 5 wherein said first material comprises cooper.

8. The heater according to claim 5 wherein said second material comprises iron.

9. The heater according to claim 5 wherein said second material comprises nickel.

10. A self regulating heater assembly comprising:

first and second heater sections including first and second heater surfaces, respectively, at which respective first and second resistance means are disposed, said first and second resistance means being responsive to alternating current flow therethrough for generating thermal energy, connection means connecting said first and second heater sections in series relative to said current flow, said, first and second heater sections comprising first and second electrically-conductive substrates, respectively, of low resistance, non-magnetic material, first and second surface layers of magnetic material disposed on said first and second heater surfaces, respectively, with a thickness of approximately one skin depth, said magnetic material having a resistance that is much higher than said low resistance, wherein at temperatures above its Curie temperature said second material becomes substantially non-magnetic, said substrates of said first and second heater sections and said connection means are integrally formed components of a common substrate folded at a fold section corresponding to said connection means to position said first and second heater surfaces in said closely spaced parallel relation with said first and second surface layers facing one another, said common substrate having length, width and thickness dimensions, said length and width dimensions being very much larger than said thickness dimension which is much larger than said skin depth; and field generating means for generating an electric field between said two heater sections to concentrate current flow through said first and second heater sections in said first and second resistance means, respectively, said field generating means including means positioning said first and second heater surfaces in closely spaced parallel relation such that current flow through said sections at any instant of time is oppositely directed, said fold section being an approximately 180° bend about a fold line extending generally parallel to said length dimension and transversely of said width dimension.

11. The heater according to claim 10 wherein said substrate includes first and second opposite longitudinal ends and a slot defined entirely through said thickness dimension extending longitudinally along said fold line from said first end of said substrate to a predetermined location spaced from said second end of said substrate, and wherein said fold section extends between said predetermined location and said secured end.

12. The heater according to claim 10 further comprising a plurality of thermally-conductive members formed integrally with said common substrate and extending from at least on edge of said common substrate.

13. The heater according to claim 12 wherein said thermally-conductive members are electrically conductive and extend from a longitudinally-extending edge of said common substrate, each of said members including a structurally weakened portion for facilitating severing of the member from said common substrate.

* * * * *